US006675764B2

(12) United States Patent
Hanshaw et al.

(10) Patent No.: US 6,675,764 B2
(45) Date of Patent: Jan. 13, 2004

(54) OIL FEED SYSTEM FOR IC ENGINE WITH VARIABLE CAMSHAFT TIMING

(75) Inventors: Jamie Charles Hanshaw, Livonia, MI (US); Michael George Aimone, Sr., Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 49 days.

(21) Appl. No.: 10/063,010

(22) Filed: Mar. 12, 2002

(65) Prior Publication Data

US 2003/0172897 A1 Sep. 18, 2003

(51) Int. Cl.[7] ..... F01L 1/34

(52) U.S. Cl. ..... 123/196 R; 123/90.17; 123/196 M

(58) Field of Search ..... 123/196 R, 196 M, 123/90.15, 90.31, 90.17, 90.27, 90.34, 90.33

(56) References Cited

U.S. PATENT DOCUMENTS

| | | | | |
|---|---|---|---|---|
| 5,474,038 | A | 12/1995 | Golovatai-Schmidt et al. | |
| 6,116,200 | A | 9/2000 | Abts et al. | |
| 6,186,104 | B1 | 2/2001 | Toril et al. | |
| 6,295,964 | B1 * | 10/2001 | DiMaria et al. | 123/196 R |

* cited by examiner

*Primary Examiner*—Henry C. Yuen
*Assistant Examiner*—Hyder Ali

(57) ABSTRACT

An oil feed system for an internal combustion engine with a variable camshaft timing mechanism includes a bracket attached to the front structure of the engine at a final location which is determined in part by the interaction of the bracket and the camshaft adjuster to which it is furnishing oil. An oil feed spud which engages the adjuster will be ablated when the engine is initially operated, so as to provide a running clearance between the VCT mechanism and the oil supply spud, while the same time allowing piloting of the oil supply spud within the variable camshaft timing mechanism.

6 Claims, 4 Drawing Sheets

OIL FEED SYSTEM FOR IC ENGINE WITH VARIABLE CAMSHAFT TIMING

BACKGROUND OF THE INVENTION

1. Field of the Invention

The present invention relates to a system for providing oil, and, in a specialized case, a pressurized oil control signal to a variable camshaft timing system of an internal combustion engine.

2. Disclosure Information

Variable camshaft timing (VCT) has been employed for some years with various vehicular engines. Of course, the term "variable" implies that the camshaft timing is changed with respect to the rotational position of the engine's crankshaft. This means that some accommodation must be made to allow the drive sprocket or hub of the camshaft to change its phasing with respect to the body of the camshaft itself. One way to accomplish this is to provide a hydraulic adjusting mechanism having a vane type of adjuster as known to those skilled in the art and suggested by this disclosure. Yet other types of hydraulically controlled VCT devices are known to those skilled in the art and suggested by its disclosure. Regardless of the type of hydraulic device used, it is necessary to input an oil pressure signal to the device to achieve the desired camshaft phase change. Feeding oil, or more specifically, a controlled oil flow, into the front of a variable camshaft timing mechanism is broadly old in the art. U.S. Pat. No. 5,474,038 discloses a system in which a rigid cam cover is machined to fit the remainder of the front cover of an engine so as to provide a well-guided oil supply spud which is by necessity centered within the rotating hub of the VCT mechanism. Oil feed systems of the type shown in the '038 patent suffer from the drawback that they offer utility only at a very high expense of machining and with the need to have a rigid cover which is precisely matched to the front cover of the engine. This results in a great deal of added expense for the engine manufacturer.

A system according to resident invention provides excellent control oil feed supply to a VCT mechanism without the need for precision machining of the engine's front cover, or for that matter more than a modicum amount of precision machining in the oil feed bracket itself.

SUMMARY OF INVENTION

An oil feed system for an internal combustion engine having variable camshaft timing includes a bracket attached to the front structure of the engine at a final location which is determined at least in part by the interaction of the bracket and the camshaft adjuster to which it is furnishing oil. The oil feed system further comprises an oil feed spud carried on the bracket and integral therewith. The spud is registered into a bore formed in the camshaft mechanism which is being furnished with oil, so as to locate the bracket with respect to the camshaft mechanism. According to another aspect of present invention the oil supply spud preferably comprises a plurality of lands and oil seals, with lands having different outside diameters such that the land with the greatest diameter will ablate as a result of elastic bending of the camshaft caused by tension within a camshaft drive chain.

An oil flow control valve is attached to the bracket of the present oil feed system, so as to allow a flow of engine oil through the spud. The oil flow control valve may comprise a solenoid actuated valve drawn from the many types of valves known to those skilled in the art and suggested by this disclosure.

An oil feed system according to present invention may further comprise a timing chain guide which is integral with the bracket attached to the front structure of the engine.

According to another aspect of the present invention, a method for mounting a combination camshaft drive chain guide and variable camshaft timing control oil feed having an integral oil feed spud, comprises the steps of placing the oil feed spud into circular registry with a bore formed in the camshaft drive concentric with the axial centerline of the camshaft, and rotating the combination camshaft drive chain guide and camshaft timing control oil feed about the axial centerline of the camshaft and into registry with mounting provisions formed in the front structure of the engine. Thereafter the combination drive chain guide and camshaft oil feed is mounted to the front structure of the engine using the mounting provisions formed in the front structure engine. A method according to present invention may further comprise the step of starting the engine or otherwise motoring or operating the engine so as to ablate a portion of the oil feed spud as a result of the bending of the camshaft caused by the tension of a camshaft drive chain.

It is an advantage of the present invention that an oil control feed may be applied to a variable camshaft timing mechanism without the necessity of dowels or other precision machined parts to locate the oil feed structure in its entirety.

It is yet another advantage of the present invention that a VCT mechanism having an oil control system may be more compact because it is not necessary to incorporate a large front cover having the VCT oil feed build therein.

Other advantages as well as objects and features of the present invention will become apparent to the reader of this specification.

DETAILED DESCRIPTION

Figure 1:
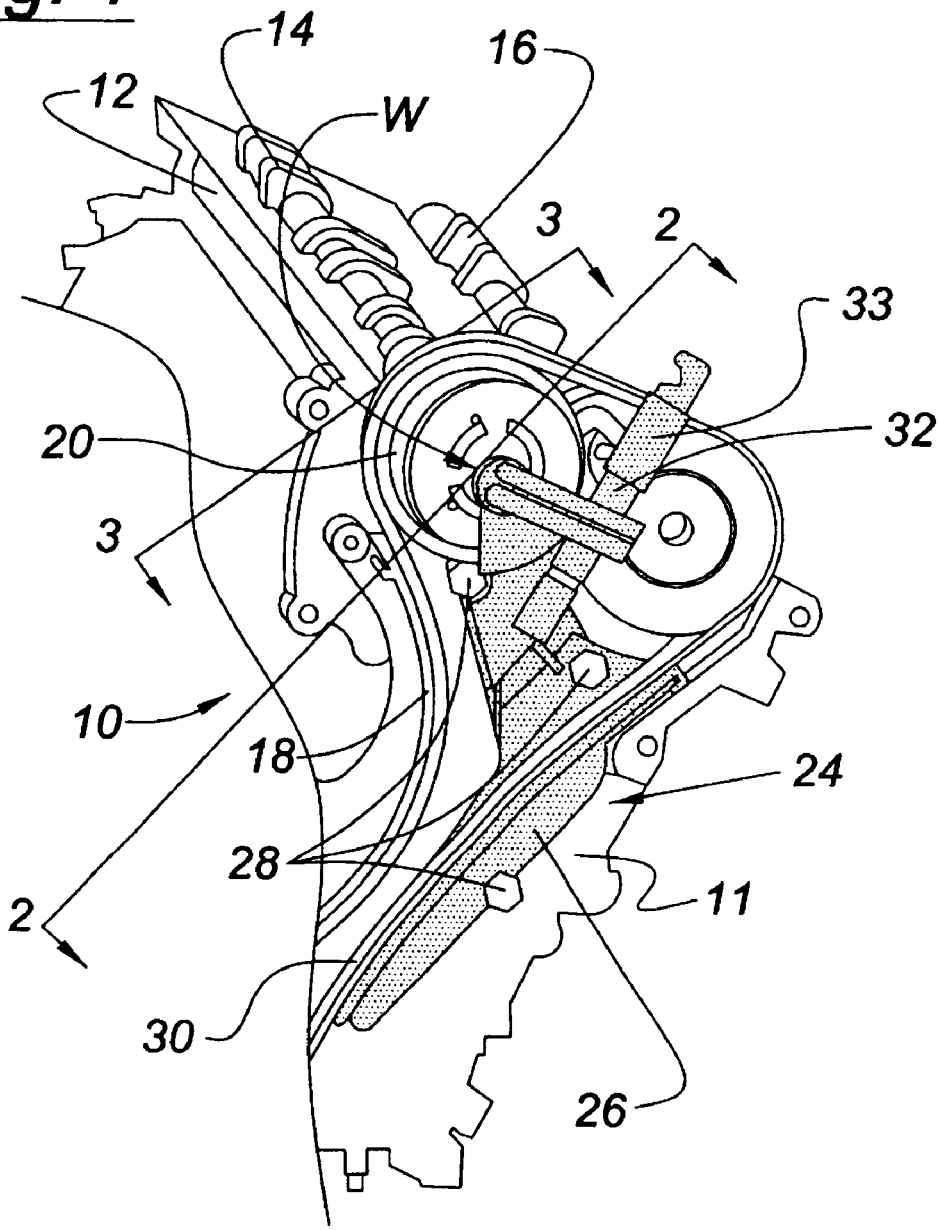
FIG. 1 is a perspective view of an engine having a camshaft with a variable timing oil feed system according to present invention.

FIG. 1 illustrates engine 10 having an oil feed system for variable camshaft timing according to present invention. Engine 10 is showing as having cylinder head 12 and cylinder block 11 attached thereto. Engine 10 is shown as intake camshaft 14 and exhaust camshaft 16. Both camshafts are driven by timing chain 18. Timing chain 18 is trained about camshaft timing adjuster 20 and thereby drives camshaft timing adjuster 20, as well as camshaft 16. Those skilled in the art will appreciate in view of this disclosure that a system according to the present invention could be used with an engine having a single overhead cam or for that matter only a single cam mounted in the valley of a V-block engine or to the side of the block of an in-line engine.

FIG. 1 also shows oil feed system 24 including bracket 26 which is maintained in connection with and mounted upon cylinder head 12 and cylinder block 11 by means of three capscrews 28. Bracket 26 also carries chain guide 30, thereby limiting the need for a separate chain guide component.

Oil fed through either cylinder head 12 or cylinder block 11 is routed into VCT mechanism 20 by means of solenoid valve 32 which is driven by solenoid 33. Both of these components are mounted with bracket 26. Those skilled in the art will appreciate in view of this disclosure, moreover, that a system according to present invention could be used for supplying oil feed to a VCT mechanism without having solenoid valve 32 or solenoid 33.

Figure 2:
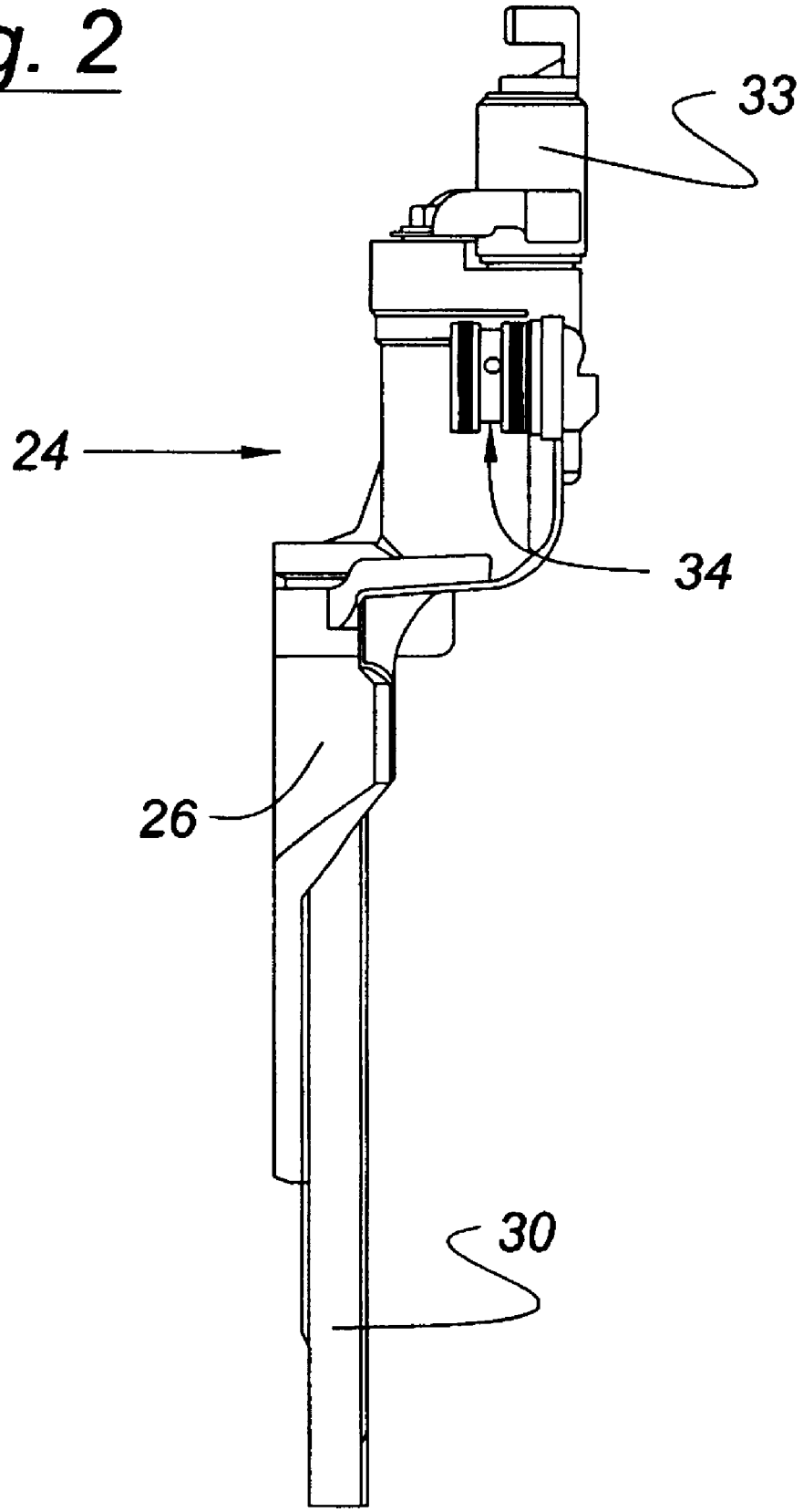
FIG. 2 is a side view of a combination camshaft drive chain guide and variable camshaft timing control oil feed, taken along the line 2—2 of FIG. 1.
Figure 3:
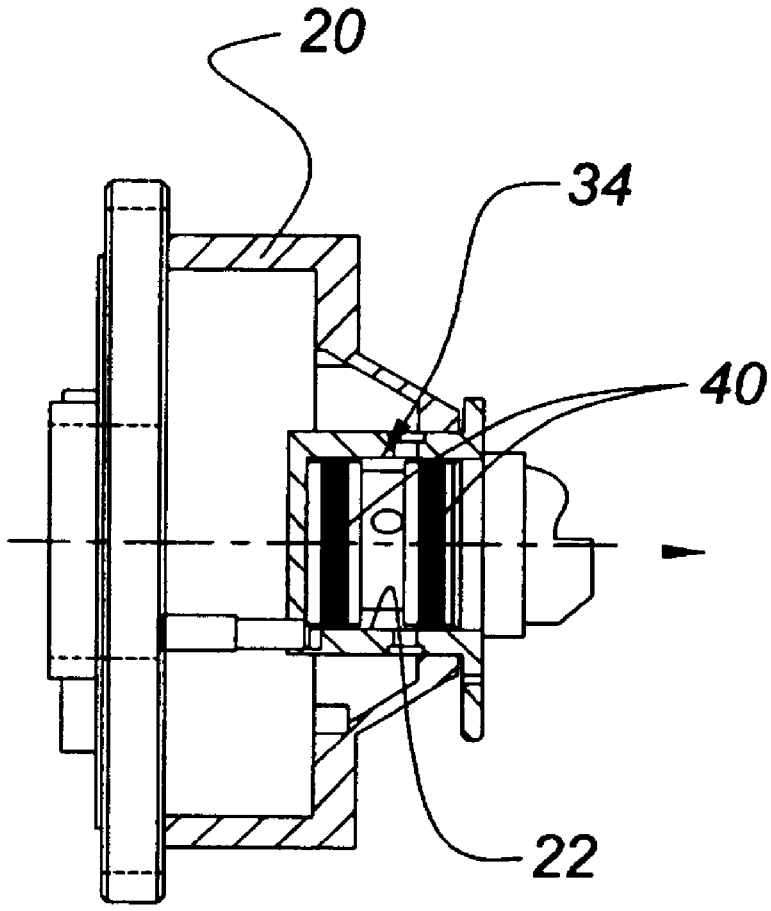
FIG. 3 is a side view, partially broken away, of a camshaft adjuster having an oil feed spud inserted therein according to the present invention, taken along the line 3—3 of FIG. 1.
Figure 4:
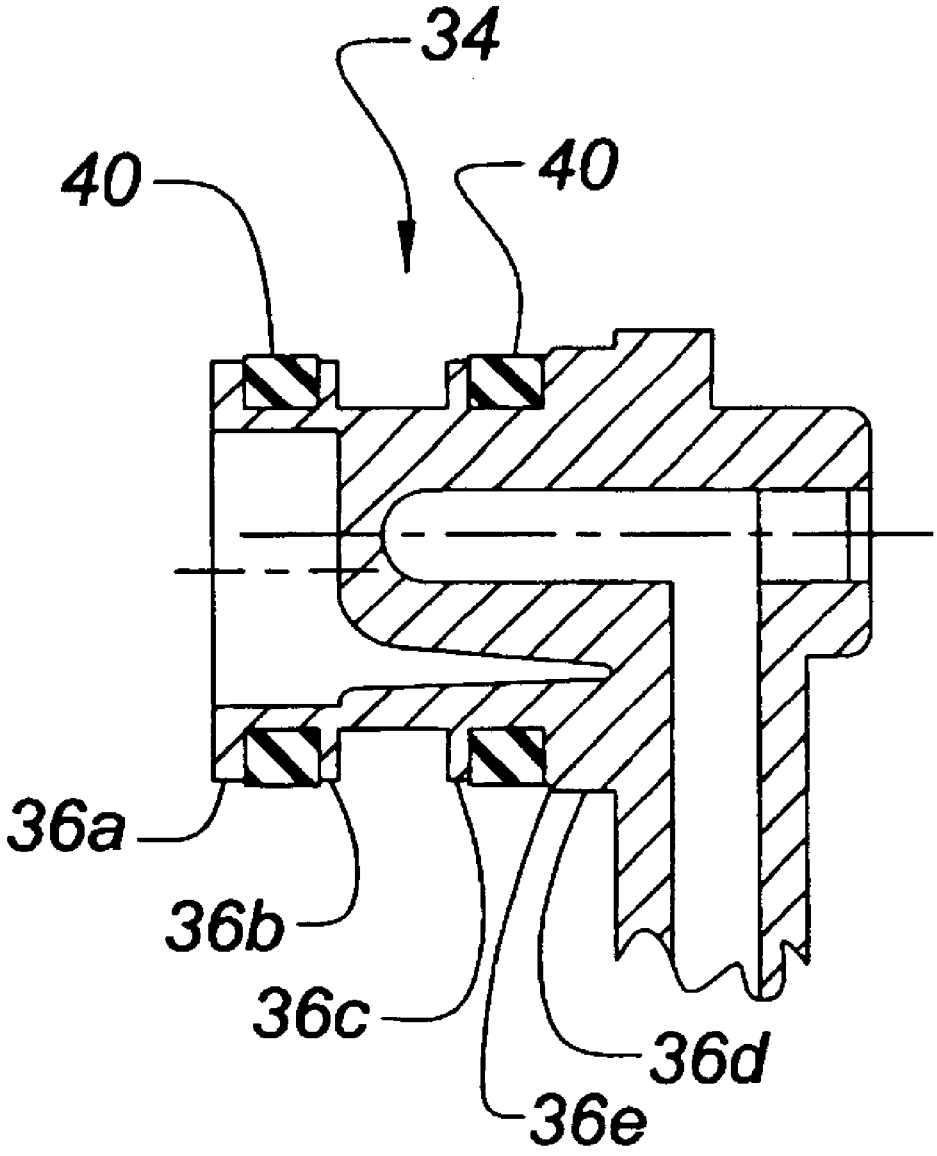
FIG. 4 is similar to FIG. 3 but includes an enlarged view of oil feed spud 34.

FIG. 2 shows greater detail of bracket 26, chain guide 30 and more particularly, oil spud 34. Oil spud 34 is circular, and as shown in FIG. 3, fits into a circular bore 22 which is formed in camshaft timing adjuster 20. Note that bore 22 maybe formed in either the parent camshaft timing adjuster or in a cylindrical portion of a toothed wheel which is mounted within camshaft timing adjuster 20. In any event, as is seen from FIG. 3, the precise location of oil feed system 24, more precisely location of spud 34 is determined by the close fit between land 36*d* shown in FIG. 4 and interior bore 22 formed in VCT mechanism 20.

Land 36*a* has a smaller outside diameter than does land 36*b*, and land 36*b* has a smaller outside diameter than land 36*c*. The outside diameter of lands 36*a*, 36*b* and 36*c* are all less than the outside diameter of land 36*d*. As a result, when a system according to present invention is assembled onto an engine, the position of spud 34, that is its radial position with respect to bore 22, will be determined by the location of land 36*d* with respect to bore 22. It is expected that the radial clearance between land 36*d* and bore 22 will be on the order of approximately 0.002 in.

According to another aspect of present invention, a method for mounting a combination camshaft drive chain guide and variable camshaft timing oil control feed having an integral oil feed spud to an internal combustion engine VCT includes the step of placing oil feed spud 34 into registry with bore 22 and then rotating bracket 24 about the axial centerline of camshaft 14 until mounting bolts 28 maybe inserted into cylinder head 12 and cylinder block 11. It is thus seen that the precise location of bracket 26 with respect to the remainder of the engine is determined predominately by the interaction of the land 36*d* formed on spud 34 with bore 22 formed in VCT mechanism 20.

When an engine having a system according to the present invention is either hot tested or cold motored for testing, a running clearance is established between land 36*d* of spud 34 and bore 22. In essence, ablation of land 36*d* generates surface 36*e* (FIG. 4), which is a slight rounding of the land's corner. This results from elastic deformation or bending of camshaft 14 in response to the tensional force of timing chain 18 acting in the direction W as shown in FIG. 1. Once the engine is operated for a brief period of time no further wear occurs because the timing chain tension, and hence, the elastic deformation of camshaft 14, is limited by a tensioner (not shown) according to conventional practice. In any event sealing rings 40 are maintained in proper registry with respect to bore 22 so as to allow required oil pressure signals to be passed to VCT mechanism 20 without a loss of signal arising from leakage past the interface of spud 34 and bore 22. This is true because once spud 34 is piloted or registered within bore 22 and then bolted or otherwise attached to at least cylinder head 12, the position of the spud will not change with respect to bore 22. Ablation of spud 34 is promoted by materials compatibility with timing adjuster 20. For example it has been determined that proper ablation occurs when spud 34 is formed from cast aluminum, with adjuster 20 comprising ferrous material in the region of bore 22.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. An oil feed system for an internal combustion engine having variable camshaft timing, comprising:

a bracket attached to the front structure of the engine at a final location which is determined in part by the interaction of the bracket and the camshaft adjuster to which it is furnishing oil; and an oil feed spud carried on said bracket which is registered into a bore formed in a camshaft mechanism which is being furnished with oil, so as to locate said bracket with respect to said camshaft adjuster, wherein said spud comprises a plurality of lands and oil seals, with said lands having different outside diameters, such that the land with the greatest diameter will locate the bracket with respect to the camshaft adjuster and ablate as a result of elastic bending of the camshaft caused by tension of a camshaft drive chain.

2. An oil feed system according to claim 1, further comprising an oil flow control valve attached to said bracket, so as to control a flow of engine oil through said spud.

3. An oil feed system according to claim 2, wherein said oil flow control valve comprises a solenoid actuated valve.

4. An oil feed system according to claim 1, further comprising a timing chain guide integral with said bracket.

5. A method of mounting a combination camshaft drive chain guide and variable camshaft timing control oil feed having an integral oil feed spud, to an internal combustion engine, comprising the steps of:

placing the oil feed spud into circular registry within a bore formed in the camshaft drive along the axial centerline of the camshaft;

rotating said combination camshaft drive chain guide and camshaft timing control oil feed about said axial centerline of the camshaft and into registry with mounting provisions formed in the front structure of the engine;

attaching the combination drive chain guide and camshaft timing control oil feed to said mounting provision found in the front structure of the engine; and operating the engine, so as to ablate a portion of said oil feed spud as a result of bending of the camshaft caused by the tension of a camshaft drive chain.

6. A method according to claim 5, where said combination drive chain guide and camshaft timing control oil feed is attached to the cylinder head and cylinder block of the engine.

* * * * *